US006803854B1

(12) United States Patent
Adams et al.

(10) Patent No.: US 6,803,854 B1
(45) Date of Patent: Oct. 12, 2004

(54) SYSTEM AND METHOD FOR ESPECIALLY GRAPHICALLY MONITORING AND/OR REMOTE CONTROLLING STATIONARY AND/OR MOBILE DEVICES

(75) Inventors: Knut Adams, Altdorf (DE); Thomas Lang, Dresden (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/937,770

(22) PCT Filed: Mar. 20, 2000

(86) PCT No.: PCT/DE00/00862

§ 371 (c)(1),
(2), (4) Date: Nov. 20, 2001

(87) PCT Pub. No.: WO00/60842

PCT Pub. Date: Oct. 12, 2000

(30) Foreign Application Priority Data

Jan. 4, 1999 (DE) ..... 199 14 829

(51) Int. Cl.[7] ..... G08B 1/08

(52) U.S. Cl. ..... 340/531; 340/937; 340/425.5; 340/426.1

(58) Field of Search ..... 340/937, 425.5, 340/426.1, 531, 426.13, 426.18, 539.1, 539.22, 539.25; 455/560

(56) References Cited

U.S. PATENT DOCUMENTS 5,844,473 A 12/1998 Kaman
5,884,221 A 3/1999 Wortham
6,002,326 A * 12/1999 Turner ..... 340/426.1
6,232,874 B1 * 5/2001 Murphy ..... 340/426.19
6,249,584 B1 * 6/2001 Hamalainen et al. ..... 380/270

FOREIGN PATENT DOCUMENTS

GB 2 194 119 A 2/1988

* cited by examiner

*Primary Examiner*—Daryl Pope
(74) *Attorney, Agent, or Firm*—Staas & Halsey LLP

(57) ABSTRACT

System and method for, in particular graphical, monitoring and/or remote control of stationary and/or mobile apparatuses The invention relates to a system and a method for, in particular graphical, monitoring and/or remote control of stationary and/or mobile apparatuses (F1 . . . Fn), in particular of vehicles, truck semitrailers, construction-industry machines, agricultural vehicles, demountable truck body systems, and/or containers, by means of a signaling apparatus (MC) from a control center (15), with the mobile apparatus (MC) having a first function block (BB) for measured-value detection, for monitoring and/or for producing an alarm in accordance with rules that can be predetermined, and having a second function block (BC) for storing application-specific data relating to the mobile apparatus (MC), and with the control center (15) and the mobile apparatus (MC) having means for communication via at least two communication channels (B1, B2), with the first communication channel (B1) being intended for communication between a communication server (KS) in the control center (15) and the second function block (BB) in the mobile apparatus (MC), and the second communication channel (B2) being intended for communication between a visualization system (VS) in the control center (15) and the second function block (BB) in the mobile apparatus (MC).

18 Claims, 3 Drawing Sheets

SYSTEM AND METHOD FOR ESPECIALLY GRAPHICALLY MONITORING AND/OR REMOTE CONTROLLING STATIONARY AND/OR MOBILE DEVICES

CROSS REFERENCE TO RELATED APPLICATIONS

This application is based on and hereby claims priority to PCT Application No. PCT/DE00/00862 filed on Mar. 20, 2000 and German Application No. 199 14 829.5 filed on Apr. 1, 1999, the contents of which are hereby incorporated by reference.

BACKGROUND OF THE INVENTION

The invention relates to a system and a method for, in particular graphical, monitoring and/or remote control of stationary and/or mobile apparatuses, in particular of vehicles, construction-industry machines and/or containers, by a signaling apparatus from a control center.

The invention furthermore relates to a signaling apparatus, a visualization, control and/or monitoring system, a computer-legible medium and a program module for such a system.

Such an apparatus is used in particular in vehicles, for example passenger vehicles, commercial vehicles, construction-industry machines, agricultural machines etc. Systematic operating data acquisition and monitoring of the vehicles are often desirable in this case.

Such an apparatus is disclosed in GB 2,194,119 A1. The data acquisition apparatus in this case contains input sensors, which record the status or specific safety or security conditions. Furthermore, a signal processing apparatus is provided, which produces a status report which includes the identity and the location of the data acquisition apparatus, as well as the respective operating data. The data acquisition apparatus is connected to a selector or to a radio telephone, which transmits the status report to a remote station.

U.S. Pat. No. 5,884,221 discloses a method and an apparatus for location of and communication with vehicles. A mobile radio unit, connected to a microprocessor, is installed in each of the vehicles. This mobile radio unit receives position-finding information from stationary transmission units, which it passes on to the microprocessor for visualization on a screen.

SUMMARY OF THE INVENTION

The invention is based on the object of ensuring simple, reliable and secure communication between the signaling apparatus and the control center.

The first function block, for measured-value detection, for monitoring and/or for producing an alarm, and the second function block, for storage of application-specific data relating to the mobile apparatus, form two logically separate function blocks, which can be combined with one another if required. The first function block thus carries out all the automatically running tasks relating to the monitoring and checking of, for example, signals supplied via sensors or to be emitted via actuators. It also includes, in particular, an alarm system, measured-value detection, measured-value preprocessing and measured-value storage. The second function block includes, in particular, the appropriate diagnostics and the application-specific programs, parameters and data sets etc. Communication with the control center can be handled via at least two communication channels. The first communication channel is used for communication between the alarm system in the first function block and/or the alarm system in the control center, with the communication server being coupled to the visualization system in the control center. The second communication channel is used by the visualization system, in order to read measured data etc. from the mobile apparatus, without being influenced or blocked by the first channel. Thus, overall, this results in the mobile apparatus having a modular design, which allows an open standard solution, which can be upgraded, for monitoring, diagnosis, transport, logistics, vehicle park and fleet management tasks in a system, and allows the use of a single mobile apparatus. The system in this case comprises one or more mobile apparatuses, with a mobile apparatus being arranged in each vehicle, and being able to communicate with either one or a number of control centers, or else with other appropriately authorized personnel. By virtue of its modularity, the mobile apparatus can be used for individual tasks and for a combination of these tasks. In consequence, the mobile apparatus and the control center, that is to say the entire system, can be used universally and in relatively large quantities, commercially. The integration of the signal/measured-value detection and processing in a mobile apparatus in the form of an on-board computer means that this provides an economic additional use for the customer, allowing integrated early fault detection in vehicles and/or load monitoring and hence also minimizing journeys for servicing/to workshops.

On-line monitoring similar to a measurement device or an oscilloscope and off-line evaluation of defect, fault and/or alarm messages can easily be ensured since the mobile apparatus includes at least one transmitting/receiving apparatus, in particular a radio transmitting/receiving apparatus for temporary connection to at least one control center and/or to a subscriber who is authorized to receive messages.

One function, which is worthwhile in particular in conjunction with fleet management, is achieved by the mobile apparatus having a third function block which has functions for position-finding and/or fleet management, and which has a device to communicate with a user at the same location as the mobile apparatus.

Short-term and/or long-term data acquisition with a large number of evaluation options, for example for servicing recommendations etc., can advantageously be ensured since the mobile apparatus has a data analyzer which, in particular, is integrated in the first function block and is intended for receiving input signals which can be predetermined and are supplied from the data analyzer by sampling data sequences from signal sources, since the mobile apparatus is provided with a date and time stamp for stamping the detected data signals, and since the mobile apparatus is intended for transmitting the sampled data sets to the control center for graphical display within a control and monitoring system.

Reliable initiation of alarm messages can be achieved in that the mobile apparatus has an alarm system which, in particular, is integrated in the first function block and is intended for transmitting alarm messages in accordance with rules which can be predetermined, and for protecting the transmitted messages.

The capability to handle alarm messages such that they can be recorded and are hence comprehensible is further improved in that the alarm system is intended for storing alarm messages in the mobile apparatus, for transmitting the alarm message to a control center which can be predetermined, and for monitoring an acknowledgement of the transmitted alarm messages by the control center.

One cost-saving option for varying parameters in the alarm apparatus, for example when the operating software is updated, can be provided, without any separate labor cost, in that the application-specific data and programs which can be stored in the second function block can be loaded remotely from a control center.

The reliable emission of alarms to a control center or to an authorized person can be further optimized in that the control center and the mobile apparatus have a device to communicate via a third communication channel, with the third communication channel being intended, in particular, for communication between the communication server and in the control center and the third block in the mobile apparatus.

The reliable, secure and unambiguous allocation of messages, even when there are a large number of signaling apparatuses in a large fleet, is ensured in that the mobile signaling apparatus has an associated identifier for identification of the mobile apparatus, in that the mobile signaling apparatus has a device to transmit the identifier to the control center together with a message, and in that the control center has a unit to store and visualize the identifier.

The messages are handled in a user-friendly manner within the control center in that the visualization system and/or the control and monitoring system have/has an alarm window for optical visualization of messages, in particular alarm, warning and defect messages and in that the alarm window has information relating to the identification of the message, in particular the identifier, time and fault description.

The user-friendliness of the system is further optimized in that the visualization system and/or the control and monitoring system in the control center have/has a device to implicitly select a mobile apparatus associated with a message, in such a way that the mobile apparatus which is associated with the selected message is automatically selected for setting up a connection by selecting said message from a message table, in particular by double-clicking or by operating an enter function.

A further option for user-friendly handling of the system is that the visualization system and/or the control and monitoring system in the control center have/has a telephone book window for visualization of each of the mobile signaling apparatuses administered by a control center.

Optimum handling with user friendliness can also be achieved for the telephone book in that the visualization system and/or the control and monitoring system in the control center have/has a device to explicitly select a mobile apparatus in such a manner that a selected mobile apparatus is automatically selected for setting up a connection by selection of said mobile apparatus from the telephone book table, in particular by double-clicking or by operation of an enter function.

Secure and reliable archiving of test results etc. can be achieved cost-effectively, without any costly use of personnel, in that the control center has a device to automatically store the data transmitted from the mobile signaling apparatus to the control center, in order to archive such data.

The location of the apparatuses which are coupled to the signaling apparatus, such as construction-industry machines, fleet vehicles etc. can be found in a simple manner in that the signaling apparatus has a GPS module for finding the position of a mobile apparatus which is coupled to the signaling apparatus, with the signaling apparatus being intended for transmission of the position-finding data to the control center, and in that the signaling apparatus uses the GPS data comprising the date and time to provide high-precision date and time stamp for data recording.

BRIEF DESCRIPTION OF THE DRAWINGS

These and other objects and advantages of the present invention will become more apparent and more readily appreciated from the following description of the preferred embodiments, taken in conjunction with the accompanying drawings of which.

DETAILED DESCRIPTION OF THE PREFERRED EMBODIMENT

Figure 1:
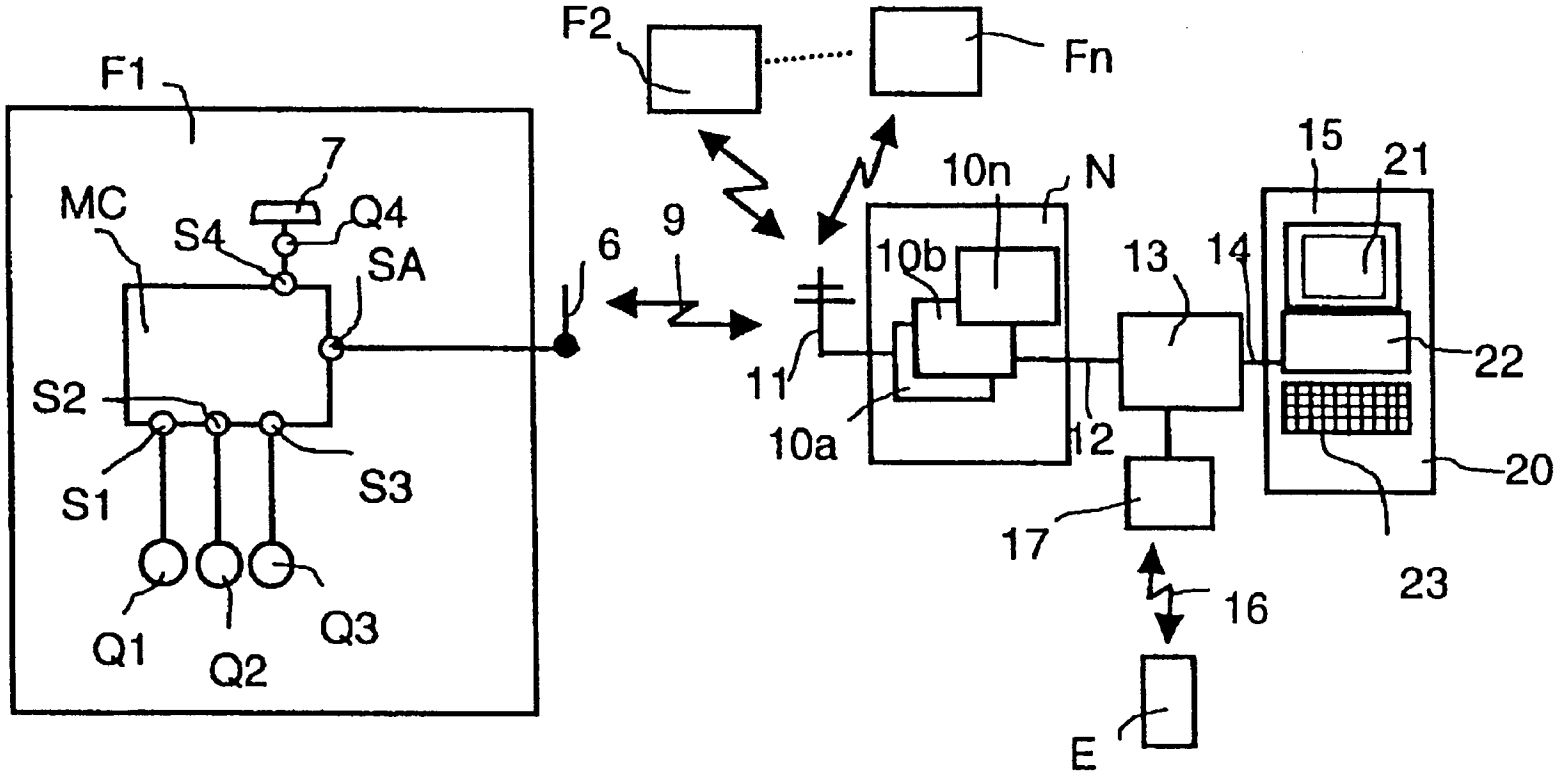
FIG. 1 shows a block diagram of an exemplary embodiment relating to the fundamental structure of a system for monitoring and/or remote control of vehicles.

Reference will now be made in detail to the preferred embodiments of the present invention, examples of which are illustrated in the accompanying drawings, wherein like reference numerals refer to like elements throughout.

FIG. 1 shows a block diagram of an exemplary embodiment of an overall system for mobile data acquisition. The data acquisition system comprises vehicles F1 . . . Fn in a vehicle fleet. The vehicles F1 . . . Fn are each equipped with a data acquisition apparatus MC, with the data acquisition apparatus MC and the interaction with further components in the respective vehicle F1 . . . Fn being shown on the basis of just the one vehicle F1 in each case. The data acquisition apparatus MC has input interfaces S1 . . . S4, via which respective input signals are supplied from data sources Q1 . . . Q4, The first interface S1 is intended, for example, for processing input signals from a communication bus, such as the CAN bus (CAN=Controller Area Network) that is used in vehicles. Operating data for the engine temperature, water temperature, oil pressure, oil temperature, battery voltage etc. are transmitted, for example, via such a data bus. The second interface S2 is, for example, in the form of a serial interface, for example for connection of a keyboard or keypad, display etc., while the third interface S3, for example an "on-board I/O" interface, is intended, for example, for connection of sensors, encoders etc. The fourth interface S4 is used for optional connection of a GPS module (GPS=Global Positioning System). The data acquisition apparatus MC has an output interface SA which forms the output, for example, of a GSM module (GSM=Global System for Mobile Communication) with the output interface being connected to a transmitting/receiving antenna 6. The vehicle F1 can set up a bidirectional data link via a radio interface 9 between the antenna 6 for the data acquisition apparatus MC and an antenna 11 for a base station 10*a* . . . 10*n*. The base stations 10*a* . . . 10*n* in a GSM mobile radio network N are connected to a network operator 13 in the mobile radio network N. There is a link 14 from the operator 13 of the mobile radio network N to a control center 15. A further data link 16 is possible, alternatively or in addition, as a mobile data link 16 between a receiver E and the operator 13, via a further base station 17. A computer 20 with a data processing apparatus 22, monitor 21 and keyboard or keypad 23 is used, for example, as the man-machine interface for communication between the control center 15 and the data acquisition apparatus MC.

FIG. 1 shows how a signaling apparatus MC is embedded within a system for monitoring and diagnosis of vehicles F1 . . . Fn, and this arrangement will be explained in more detail using the example of the signaling apparatus MC contained in the vehicle F1. Instead of the vehicles F1 . . . Fn, illustrated in FIG. 1, it is also possible to include other mobile and stationary apparatuses such as vehicles, machines, for example construction-industry vehicles, cranes, containers, tracked vehicles, etc. within such a system. The signaling apparatus MC has input interfaces S1 . . . S4, via which input signals which originate from data sources Q1 . . . Q4 can be supplied. Such input signals may, for example, be signals which relate to the operational reliability or safety of the vehicle F1 . . . Fn such as the water temperature, oil temperature, coolant temperature of a refrigerated vehicle, etc. The signaling apparatus MC is used for recording, in accordance with stored rules and at specific times, in accordance with the input signals defined in the data acquisition apparatus MC. The signals recorded in this way can then be transmitted via the output interface, either on request from the control center 15 or on request from some other receiver E, via the output interface to the control center 15 and/or to the receiver E. This allows, for example, effective fault diagnosis in the event of a defect in the vehicle F1 . . . Fn. Furthermore, it is possible for input signals 1*a* . . . 4*a*, which are defined in the data acquisition apparatus MC to be derived, for example, automatically in the MC from the signals over a short time period, for example by trigger events or to be started or stopped and/or recorded on command from the control center thus obtaining highly up-to-date machine/vehicle states on the basis of a highly up-to-date display, and initiating appropriate servicing and/or repair measures etc. Signals can also be recorded over a short time period, for example, in the form of a direct dialog link between the control center 15 and the data acquisition apparatus MC, via an on-line link in the form of the air interface 9. The rules in the data acquisition apparatus MC may be designed such that alarms can be produced automatically when specific defect events occur, for example when limit values are exceeded. The data acquisition apparatus MC can furthermore use the location data supplied via the GPS antenna 4 to transmit location data to the control center, and to apply high-precision date and time stamping to the signal recording in the MC. This provides not only theft monitoring but also a clear method for fleet management of the vehicles in a vehicle fleet F1 . . . Fn which can be recorded from the control center 15. Furthermore, if required, the radio link 9 between the control center 15 and the vehicle F1 can also be used to provide a voice link between the driver of the vehicle F1 and the control center 15 without any separate radio transmitting/receiving apparatus being required for this purpose. In addition, in the event of a fault, for example, a notebook etc. can also be connected, for example, in situ via the interface S2, so that the recorded signals can be evaluated in situ for fault tracing. An optimum display of the information transmitted from the data acquisition apparatus MC to the control center 15 is facilitated by installing in the computer device 22 a software packet which is based, for example, on the WinCC control and monitoring system from Siemens or an OPC (OLE for Process Control) based system, or on operating systems such as Windows. This also optimizes the administration, for example of the incoming alarm messages. Furthermore, specific information for vehicles F1 . . . Fn, such as traffic radio, routing, date and/or order data etc., can be transmitted on a vehicle-specific basis or fleet-specific basis from the control center. The rules in the data acquisition apparatus MC for detection and transmission of input signal data to the control center are stored in the data acquisition apparatus MC in such a way that the rules can be loaded remotely from the control center 15 to the data acquisition apparatus MC via the air interface 9.

Figure 2:
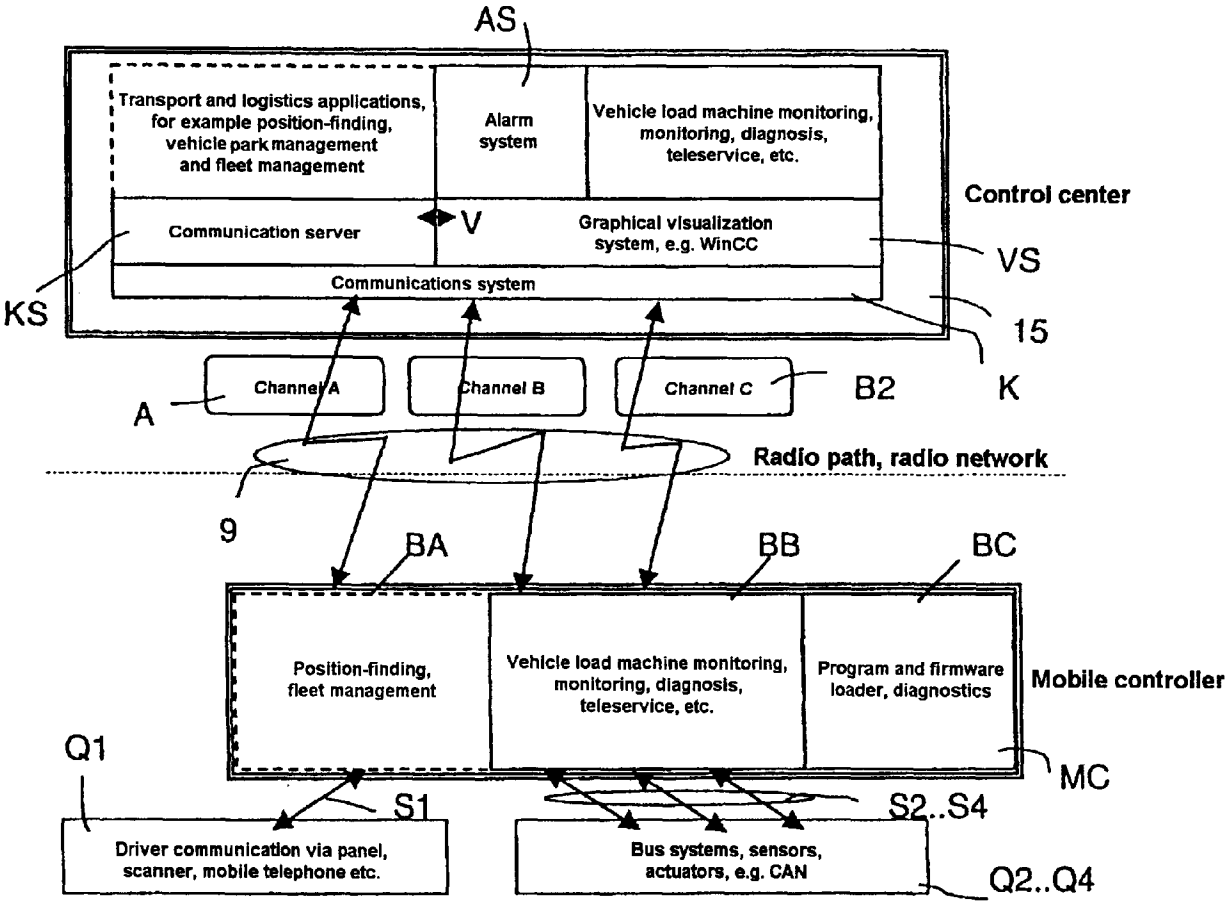
FIG. 2 shows a schematic illustration showing the basic structure of the architecture and overall configuration of a signaling system.

FIG. 2 shows a schematic illustration of the basic structure of the architecture and overall configuration of a system for graphical monitoring and/or the remote control of stationary and/or mobile apparatuses MC from a control center 15 via respective temporarily switchable radio paths 9. The mobile apparatus MC, which is also referred to in the following text as a mobile controller or as a signaling apparatus MC, contains three logically separated function blocks BA, BB, BC, which can be combined with one another as required. The function block BA comprises the functions for position-finding (for example GPS position-finding), fleet management etc. and has a first interface S1 for driver communication via a panel, scanner etc. The function block BB is used for measured-value detection, monitoring and/or producing alarms in accordance with rules which can be predetermined. The function block BC is used in particular for storage of application-specific data for the mobile apparatus MC. The function BB can be coupled to data sources Q2 . . . Q4 via interfaces S2 . . . S4. The control center 15 is characterized in that it is able to distinguish between three separate logical channels A, B1, B2. Depending on whether the control center has direct access to the radio network via radio modems, or whether it is connected via ISDN or the Internet, these channels A, B1, B2 may also be physically separate, for example for direct GSM access (SMS and GSM data). Functionally, the control center contains three function blocks, namely a communication server KS, a graphical visualization system VS, and the alarm system AS. These blocks control a lower-level communication system. The channel A is used for communication between the communication server KS and the block BA in the mobile apparatus MC, while the channel B1 is intended for communication between the alarm system AS and the block BB. The channel B2 is used for communication between the visualization system VS and the block BB in the mobile apparatus MC. In the exemplary embodiment illustrated in FIG. 2, the channels A, B1, B2 are in the form of a radio path via an air interface 9. The system illustrated in FIG. 2 is based on PLC technology (PLC=programmable logic controller), which is used in the automation field.

The system illustrated in FIG. 2 can be expanded in a modular fashion and can be used universally for monitoring, diagnosis, teleservice, GPS position-finding etc., in particular universally for tasks relating to logistics and fleet management. The control center 15 is in this case, for example, in the form of a WinCC station, that is to say the control center 15 uses the Siemens WinCC system as the control and monitoring system. The modular architecture of the mobile apparatus MC makes it easy to combine with other software systems. The architecture with the separate function blocks and the separate channels A, B1, B2 guarantees that the alarm signal, diagnosis and driver communication to the control center can be carried out in parallel, in time.

Figure 3:
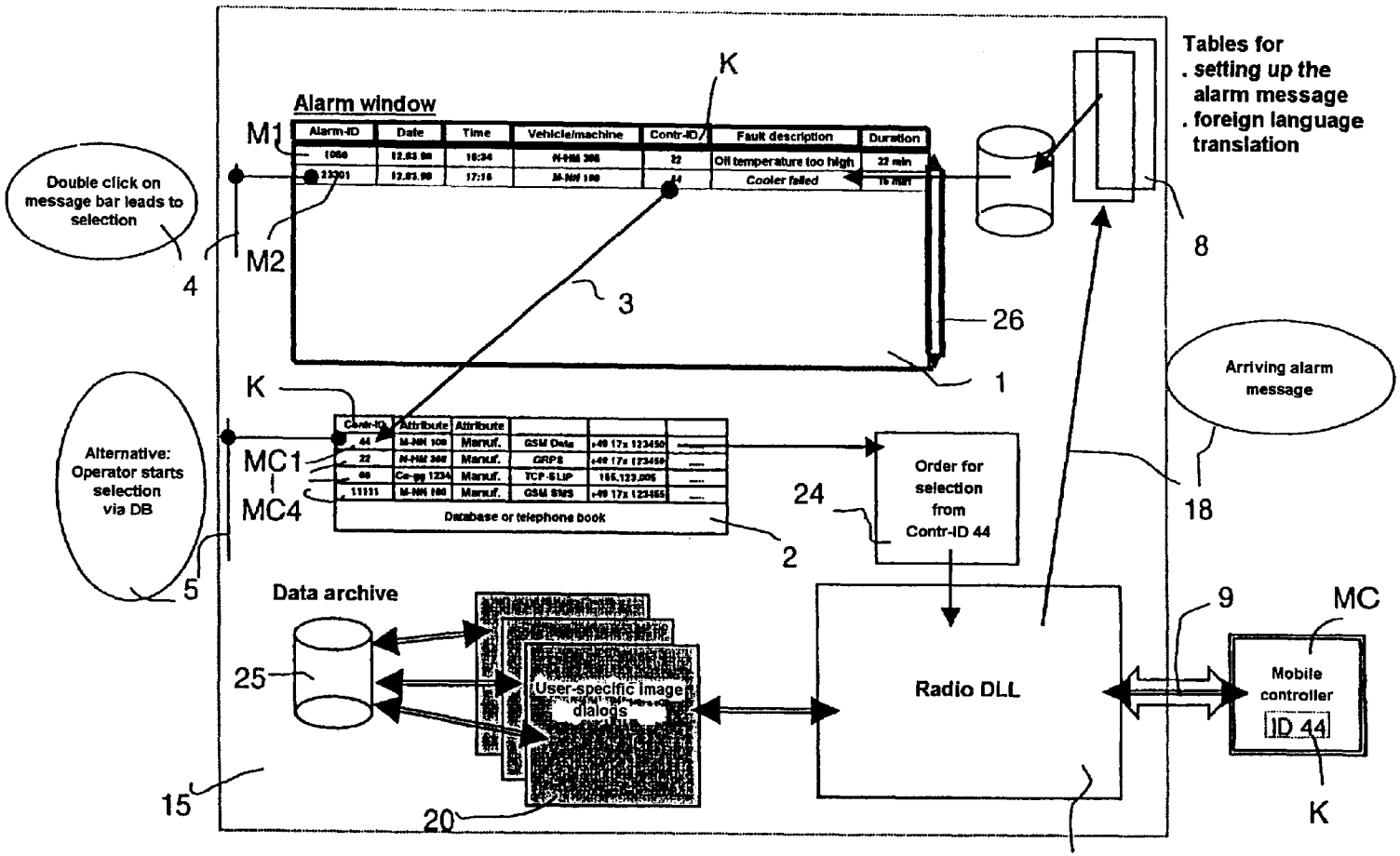
FIG. 3 shows a schematic illustration relating to graphical alarm processing by a visualization, control and/or monitoring system.

FIG. 3 shows a schematic illustration of the graphical alarm processing by a visualization, control and/or monitoring system. FIG. 3 in this case shows the fundamental function blocks, comprising the mobile apparatus MC and the control center 15. The mobile apparatus MC is a mobile controller with a specific, unique identifier K, in the present case with the ID44 control. This identifier is stored in the mobile controller MC, and is transmitted via the radio interface 9 to the control center 15. The control center 15 contains a communication driver 19, for example a radio DLL 19 (DLL=Dynamic Link Library). The radio DLL is used for administration of the subscribers, that is to say of the mobile apparatuses MC administered in the control center 15 and for including the subscriber-specific data in user-specific image dialogs 20, which are coupled to data archives 25. When an alarm message 18 arrives from the mobile controller MC1 at the control center 15, the radio DLL 19 uses unit 8 to set up an alarm message to enter the received alarm message in an alarm window 1 as a message M2. The alarm window 1 comprises rows and columns, with each row having one messages M1, M2, in each case associated with it. The columns contain data associated with the respective message M1, M2 these being, in the case of the alarm window 1 illustrated in FIG. 3, the alarm identifier, the date, the time, the vehicle license number, the control identifier, the fault description and the duration of the fault that has occurred. The user in the control center 15 can automatically dial 24 the control center for the mobile controller MC, on the basis of the message M2 visualized in the alarm window 1, by initiating a step 4 by using the PC mouse to double-click on the message row for the message M2, via an access step 3 in a telephone book 2. In this way, a radio link to the associated mobile controller MC1 is set up directly once the user has double-clicked on the selection of the alarm message M2, or has pushed a key for this purpose. This is also referred to as implicit controller selection, in the following text. As an alternative, explicit controller selection is possible by process step 5. In this case, implicit controller selection is possible from the telephone book 2 on the basis of the identifiers, stored there, for the mobile controllers MC1 . . . MC4 and the associated attributes such as license numbers, manufacturers and an associated radio link in the form of the associated telephone number. The selection and operation of the radio path in this case is once again carried out by a specific driver, for example in the form of the radio DLL 19. This driver handles all the communication with the controller MC1 . . . MC4.

The invention is intended to allow parallel operation of monitoring/diagnosis/teleservice and telemaintenance with GPS position-finding, transport, logistics, vehicle park and fleet management tasks in one system, and with a single mobile controller. In this case, one application comprises one or more mobile controllers (one controller per vehicle) and one or more WinCC control centers. The controller can be used for individual tasks, or for a combination of these tasks. The mobile controller and the WinCC control center can thus be used universally and in relatively large quantities commercially. The integration of the signal/measured-value detection and processing in a mobile controller (on-board computer) results in an additional financial benefit for a customer due to the integrated early fault detection in a vehicle or load monitoring, and by minimizing journeys for servicing/to workshops.

For vehicle/load monitoring and monitoring of construction-industry machines or physically remote machines which are operated without using PLC technology there has not yet been any commercially available, open and upgradeable standard software solution for the control center.

In the past, at the mobile appliance, there have been:

PLC solutions, although these are not particularly suitable for monitoring and diagnosis in the mobile area. There is no proven, robust automatic alarm system from the field to the control center, and there are no real-time measurement capabilities either.

no modular and combinable controllers on the market which can be used universally. Instead of this, appliances are specialized for each application, for example, PLC, GPS position-finding appliances, fleet management appliances, or else single-purpose in-house developments by the machine constructors for teleservice.

no universal monitoring or diagnosis appliances on the market which can be used for construction-industry machines and commercial vehicles or for machine monitoring outdoors. Expensive specific solutions do exist, for example in the turbine and power station fields.

The control center is in the form of a WinCC station. For fleet management/transport and logistics tasks and for GPS position-finding (using map software), a commercially available software system which is compliant, for example, with FAP (Fleet Application Protocol) can be operated in parallel with WinCC. It is thus possible, in conjunction with the invention, to obtain such software (for example MAP&GUIDE), without any expensive in-house development. WinCC thus also becomes useable in the freight-forwarding sector or for vehicle park monitoring. All sensor/actuator-related automatic monitoring and processing is handled logically separately, by interaction between the controller and WinCC.

The special features of the invention are:

architecture which allows WinCC to be combined with other commercially available software systems.

universal architecture, even for future self-monitoring and remote-diagnosis tasks on vehicles, such as passenger vehicles, commercial vehicles, construction-industry machines.

architecture guaranteeing time parallelity of the alarm channel to the control center and teleservice function to individual/a number of mobile controllers.

real-time data recording and evaluation in situ even over slow (radio) paths feasible by a data analyzer function (comparable to a digital oscilloscope function).

alarm system based on WinCC with "single-click" selection for the monitoring/teleservice mode.

alarm system with automatic acknowledgement following successful alarm archiving in the control center, and automatic repetition of the alarm transmission in unprotected radio networks (SMS), for robust operation without an operator.

dynamically self-matching alarm system on a mobile controller, in order to prevent alarm overload resulting from identical recurrent alarm messages.

WinCC with GPS theft monitoring/alarm production.

The described architecture is designed for use via radio paths, for example mobile radio networks such as GSM, GPRS, UMTS etc., via satellite radio or via "short-range radio". In addition, it is characterized in that the application solution remains neutral irrespective of the implementation of the services, protocol stacks, superimposed on the networks.

Fundamentally, the configuration consists of a control center and a number of mobile controllers, which are temporarily connected via a radio path.

The architecture of the signaling apparatus MC (=Mobile Controller) offers the special feature that one and the same controller can be used for pure monitoring tasks for mobile or stationary machines, construction-industry machines, and vehicles up to applications for transport and in the logistics field. For this purpose, the "controller" appliance in conjunction with a multitasking operating system combines three logically separate function blocks A, B and C, which can be combined with one another as required. The function block BA (FIG. 2) comprises the functions for position-finding (for example GPS), fleet management etc., and is characterized by interaction with the driver via various input options.

The logically separate block BB carries out all the tasks that run automatically relating to the monitoring and checking of all the sensors, actuators and the vehicle bus systems (for example CAN) or fieldbus. These characteristic features are its alarm system, measured-value detection, preprocessing and storing using, for example, a datalogger, a data analyzer, a classification function, and limit-value monitoring.

The data analyzer is characterized in that, in conjunction with a high signal sampling rate on all the signal inputs and the objects on the bus systems, it allows very rapid measurement sequences of signals associated in time, with precise date and time stamping. The complete recorded data block, comprising a number of data sets, can be displayed graphically, after being transmitted to the control center, at the right time and with high time resolution. This ensures measured-value detection and preprocessing of signals in the MC which it would otherwise be impossible to observe in real time from the control center, via the radio path.

The special feature of the alarm system is the protection of the message transmission to the control center. In the controller, alarm, defect and warning messages are produced when defined signal states are reached or when external signals exceed limit values. These messages are buffer-stored in a controller spool system when they occur. The controller sends these alarms successively by radio to the control center. The control center must acknowledge each message individually and automatically after reception and archiving, by a logic acknowledgement to the controller. The transmitted message is not deleted in the controller (in the spool) until this has been done. If messages that have been sent are not acknowledged by the control center within a time which can be selected, the controller automatically repeats the transmission of the corresponding message.

The block BC contains diagnostics as well as upload and download functions for the appliance software in the controller itself, as well as application-specific programs, parameters and data sets.

The control center is characterized in that it distinguishes between three separate logical channels. These channels may also be physically separate, for example in the case of GSM direct access (SMS and GSM data) depending on whether the control center has direct access via radio modems to the radio network, or is connected via ISDN or the Internet.

All the communication relating to the position-finding and fleet management is passed via channel A. The communication server carries out the distribution function for applications which are based on FAP (Fleet Application Protocol).

All the communication between the alarm system and the graphical visualization system in the control center passes via channel B1 as the "alarm channel", either via the communication server (link V) or directly to WinCC. This offers the advantage that a number of applications, such as fleet management and vehicle, load, machine monitoring, teleservice etc., can be integrated in one control center.

The visualization system itself uses a separate channel B2 in order to handle services with large volumes of data and/or with strict timing requirements. However, in parallel with this, and even if B2 is blocked by a permanent direct radio link, all the alarm messages from the field can still reach the control center via channel A without any disturbance.

The alarm window in FIG. 3 shows the alarm, warning and defect messages arriving from the individual controllers, or from a number of controllers, in the field. The structure within the alarm window is based on rows or columns. In order to provide a multilingual interface (which can be set individually on each workstation) and in order to reduce the amount of data to be transmitted, only the alarm-relevant data, such as alarm/defect identification, date and time of the triggering event, possibly together with its duration and additional parameters, are transmitted by radio to the control center.

Furthermore, a unique identifier (for example the ID of the controller or the serial/chassis No.) is also transmitted in order to identify a mobile appliance or vehicle.

The data transmitted in this way is translated to the language-specific plain-text messages by a table structure, after being received in the control center. This table (and possibly also a number of tables) contains a translation for each language used, per identifier, as plain text. A similar situation applies to the format conversion between national/language-typical formats or notations such as the time/date and additional parameters. The actual messages are formed from this, are entered in the alarm archive, and are overlaid successively in the alarm window.

The visible contents of the alarm window are restricted to a finite number of alarm/warning and defect messages. It is thus possible for the user to use a slide (26) or up/down buttons to shift the visible part of the alarm window over all the stored messages.

The reason for an alarm, warning or defect message that has arrived from a mobile controller can be found by a minimum number of control actions by selecting the appropriate controller directly by radio, in order to read further details from the controller by teleservice, or to carry out diagnosis or remote maintenance. For this purpose, it is sufficient to mark the appropriate message in the alarm window by clicking on the mouse, or by using the cursor. The radio link to the associated mobile controller is set up, see implicit controller selection above, directly after this by double-clicking or pushing a key.

A telephone book or database is used for administration of all the information of how each controller can be accessed in the field, for example the communication service, addresses or subscriber number, for example mobile radio number. Further additional information is used to make it easier for a user to carry out a search; for example, it is easier for him to find an official vehicle license number and to select this than a controller ID. An operator can then deliberately select a controller explicitly by selecting a telephone book entry and double-clicking or pushing a key.

In contrast to explicit controller selection the radio link to the associated controller is set up when using implicit controller selection by double-clicking on a message in the alarm window. Double-clicking results in the associated program taking the unique identifier relating to the controller ID and determining all the data required for selection, from the above mentioned database. This results in the setting up of the order block for selection of the controller. A specific driver (for example DLL Dynamic Link Library) is used for selecting and operating the radio path. This driver handles all the communication with the controllers in the field and provides a program interface for any desired user programs, and for all the subsequent screen dialog programs. A software download to the controller, for example, is also handled in this way.

The image dialogs are also supplied via the driver with the necessary data from the controller. In order to optimize the radio communication and to speed up the setting up of the screen, it is possible to use an order to selectively request from the controller only such data, and to load it into the control center, which is required for the respective function or the respective image. The selection process may also mean different time cycles for updating each individual data field. This is independent of the transmission type and medium, and is dealt with by the specific driver or drivers.

The image dialog formats are dependent on the respective application, and the dialogs can use variables for read and write access to the controller. The data read from a controller to the control center is written to files via the image dialogs for archiving.

The following text contains further explanatory notes relating to the implementation of the alarm system: a user of a mobile system is in this way intended to be made aware of certain events, such as defects. In order to take account of the system's intrinsic unreliability in the communication path, functions are required for storing the events that occurred in the mobile system until they are centrally archived in the B&B station. In order to prevent the alarm archive from being overloaded by the same events or alarms, it must be possible to limit identical entries. This also assists in minimizing the transmission costs.

In order to satisfy these requirements, the mobile controller has a remanent alarm archive. Various remanent media such as battery-buffered RAM, flash EPROM, EEPROM . . . can be used for this purpose. The number of entries for one and the same alarm message can be restricted by the configuration process. Firstly to prevent the alarm archive from being blocked in the event of faulty signals which lead to the alarm message being triggered repeatedly, and secondly to prevent it being blocked in the event of relatively long failures of the communication path.

The mobile system sends an alarm message that has newly arrived in the controller as soon as a communication order can be produced. An alarm message is not erased in the controller until a logic acknowledgement arrives from the alarm message recipient, that is to say from the control center, at the controller. This acknowledgement may arrive immediately or following a delay, depending on the medium or service. Logical or physical links may be used (for example, serial as well as stream or packet-oriented links, for example data transmission via IP, GSM, GPRS or any other transmission protocol or service). If no acknowledgement arrives from the recipient of an alarm message within a configurable time, another transmission attempt is started. At the receiver end (for example in the control center with WinCC), the acknowledgement for an alarm message is sent automatically to the mobile system once this message has been archived. If an alarm message reaches the maximum configured number of identical messages in the controller, this is noted in the next transmitted alarm message. Acknowledgements which arrive after this now no longer cancel the entry inhibit for this alarm message, in order to prevent there being an unnecessary large number of messages on the path to the control center. This entry inhibit can be canceled again only by a special order. This response in the alarm system is switchable, and can be switched off. In the control center, there are suitable provisions to make the operator aware of this alarm message overflow. The user is provided with functions for initiating the enable order for the entry inhibit that has previously been set.

In one exemplary embodiment of the alarm system, the alarm archive is in the form of battery-buffered RAM. The alarm messages are transmitted via GSM-SMS to WinCC. After being received in the WinCC archive (=long-term storage), the WinCC sends an acknowledgement via GSM-SMS back to the transmitter. Alarm messages which have reached the entry limit are specifically emphasized. The WinCC user is provided with a dialog for reading all the overflowing alarm messages, with an option to subsequently enable them.

In summary, the invention thus relates to a system and a method for, in particular graphical, monitoring and/or remote control of stationary and/or mobile apparatuses F1 . . . Fn, in particular in vehicles, construction-industry machines and/or containers, by a signaling apparatus MC from a control center 15, with the mobile apparatus MC having a first function block BB for measured-value detection, for monitoring and/or for producing an alarm in accordance with rules that can be predetermined, and having a second function block BC for storing application-specific data relating to the mobile apparatus MC, and with the control center 15 and the mobile apparatus MC can communicate via at least two communication channels B1, B2, with the first communication channel B1 being intended for communication between a communication server KS in the control center 15 and the second function block BB in the mobile apparatus MC, and the second communication channel B2 being intended for communication between a visualization system VS in the control center 15 and the second function block BB in the mobile apparatus MC.

The invention has been described in detail with particular reference to preferred embodiments thereof and examples, but it will be understood that variations and modifications can be effected within the spirit and scope of the invention.

What is claimed is:

1. A system for monitoring mobile apparatuses, comprising:

a mobile signaling apparatus having a first function block for measured- value detection, to perform at least one of monitoring and producing an alarm in accordance with predetermined rules, and having a second function block for storing application-specific data relating to the mobile signaling apparatus; and a control center having an alarm system, a communication server, and a visualization system, the control center being connected to the mobile signaling apparatus via at least two communication channels, with the first communication channel providing communication between at least one of the alarm system and the communication server in the control center and the second function block in the mobile signaling apparatus, and the second communication channel providing communication between the visualization system in the control center and the second function block in the mobile signaling apparatus, the visualization system in the control center having a selection unit to implicitly select the mobile signaling apparatus associated with a message, in such a way that the mobile signaling apparatus associated with the message is automatically selected for setting up a connection by choosing the message from a message table.

2. The system as claimed in claim 1, wherein the mobile signaling apparatus has at least one radio transmitting/receiving apparatus for temporary connection to at least one control center and to a subscriber who is authorized to receive messages.

3. The system as claimed in claim 1, wherein the mobile signaling apparatus has a third function block which has functions for position-finding and vehicle park management and/or fleet management, and which has means for communication with a user at the same location as the mobile signaling apparatus.

4. The system as claimed in claim 1, wherein the mobile signaling apparatus has a data analyzer which is integrated in the first function block and receives predetermined input signals supplied from the data analyzer by sampling data sequences from signal sources, the mobile signaling apparatus is provided with a date and time stamp for stamping the detected data signals, and the mobile signaling apparatus is intended for transmitting the sampled data sets to the control center for graphical display within a control and monitoring system.

5. The system as claimed in claim 1, wherein the mobile signaling apparatus has an alarm system which is integrated in the first function block for transmitting alarm messages in accordance with predetermined rules, and for protecting the transmitted messages.

6. The system as claimed in claim 5, wherein the alarm system stores alarm messages in the mobile signaling apparatus, transmits the alarm message to a predetermined control center, and monitors an acknowledgement of the transmitted alarm messages by the control center.

7. The system as claimed in claim 1, wherein the application-specific data and programs which can be stored in the second function block can be loaded remotely from a control center.

8. The system as claimed in claim 3, wherein the control center and the mobile signaling apparatus communicate via a third communication channel, with the third communication channel being used for communication between the communication server in the control center and the third block in the mobile signaling apparatus.

9. The system as claimed in claim 1, wherein the mobile signaling apparatus has an associated identifier for identification of the mobile signaling apparatus, the mobile signaling apparatus has a transmitter to transmit the identifier to the control center together with a message, and the control center has a storage and visualization unit to store and view the identifier.

10. The system as claimed in claim 1, wherein at least one of the visualization system and the control and monitoring system has an alarm window for optical visualization of messages, and the alarm window has information relating to the identification of the message.

11. The system as claimed in claim 1, wherein at least one of the visualization system and the control and monitoring system in the control center has a telephone book window for visualization of each of the mobile signaling apparatuses administered by a control center.

12. The system as claimed in claim 1, wherein at least one of the visualization system the control and monitoring system in the control center has a selection unit to explicitly select a mobile signaling apparatus in such a manner that a mobile signaling apparatus is automatically selected for setting up a connection by selection of said mobile signaling apparatus from the telephone book table.

13. The system as claimed in claim 1, wherein the control center has a storage unit to store the data transmitted from the mobile signaling apparatus to the control center, in order to archive such data.

14. The system as claimed in claim 1, wherein the mobile signaling apparatus has a GPS module for finding the position of a mobile apparatus which is coupled to the mobile signaling apparatus, with the mobile signaling apparatus transmitting the position-finding data to the control center.

15. The system as claimed in claim 1, wherein the messages are chosen from the message table by a double clicking or by operating an enter function.

16. The system as claimed in claim 10, wherein the alarm window visually displays at least one of an alarm message, a warning message and a defect message, and the information relating to the identification of the message includes a date and fault description.

17. A method for monitoring mobile apparatuses coupled to a mobile signaling apparatus, comprising:

using a first function block in the mobile signaling apparatus to detect measured values, to monitor the measured values and to emit alarms in accordance with predetermined rules;

using a second function block to store application-specific data relating to the mobile signaling apparatus;

communicating between the control center and the mobile signaling apparatus via at least two communication channels;

communicating over the first communication channel between an alarm system and a communication system in the control center and the first function block in the mobile signaling apparatus; and communicating over the second communication channel between a visualization system in the control center and the first function block in the mobile signaling apparatus.

18. A computer readable medium storing a program to control a computer to perform a method for monitoring mobile apparatuses, comprising:

using a first function block in the mobile signaling apparatus to detect measured values, to monitor the measured values and to emit alarms in accordance with predetermined rules;

using a second function block to store application-specific data relating to the mobile signaling apparatus;

communicating between the control center and the mobile signaling apparatus via at least two communication channels;

communicating over the first communication channel between an alarm system and a communication system in the control center and the first function block in the mobile signaling apparatus; and communicating over the second communication channel between a visualization system in the control center and the first function block in the mobile signaling apparatus.

* * * * *

UNITED STATES PATENT AND TRADEMARK OFFICE

CERTIFICATE OF CORRECTION

PATENT NO. : 6,803,854 B1
DATED : October 12, 2004
INVENTOR(S) : Knut Adams et al.

It is certified that error appears in the above-identified patent and that said Letters Patent is hereby corrected as shown below:

Title Page,
Item [30], Foreign Application Priorty Data, change "January 4, 1999" to -- April 1, 1999 --.

Signed and Sealed this

Fifteenth Day of March, 2005

JON W. DUDAS
*Director of the United States Patent and Trademark Office*